United States Patent [19]

Langwell

[11] Patent Number: 4,572,380

[45] Date of Patent: Feb. 25, 1986

[54] PAD HOLDER ADAPTED FOR MULTIPLE MODES OF MOUNTING AND ASSOCIATED METHODS

[75] Inventor: John D. Langwell, Freeport, N.Y.

[73] Assignee: Herman Alexander, Merrick, N.Y.

[21] Appl. No.: 508,491

[22] Filed: Jun. 27, 1983

Related U.S. Application Data

[63] Continuation-in-part of Ser. No. 402,535, Jul. 28, 1982.

[51] Int. Cl.[4] ..... A47F 7/00

[52] U.S. Cl. ..... 211/57.1; 40/11 R; 40/16.4; 206/449; 206/493; 206/806; 248/221.4; 248/225.1; 402/19

[58] Field of Search ..... 211/57.1, 59.1, 54.1; 206/526, 806, 813, 460, 806, 449, 493; 40/11 R, 10 R, 16.4, 16.2, 124.2, 124.4, 124, 308, 22, 312; 248/220.3, 220.4, 221.1, 221.2, 309.2, 205.3, 221.4, 224.1, 214, 215, 220.2, 225.1; 402/19

[56] References Cited

U.S. PATENT DOCUMENTS

| | | | |
|---|---|---|---|
| 1,259,337 | 3/1918 | Agnew | 40/16.4 |
| 2,559,556 | 7/1951 | Ambler | 402/15 |
| 2,925,239 | 2/1960 | Luck | 40/11 R X |
| 3,216,584 | 11/1965 | Sedo | 248/220.3 X |
| 3,815,756 | 6/1974 | Cox | 248/309.2 X |
| 3,854,584 | 12/1974 | Olson | 206/806 X |
| 4,016,977 | 4/1977 | Krautsack | 248/221.4 X |
| 4,113,109 | 9/1978 | Donnelli et al. | 206/806 X |
| 4,152,851 | 5/1979 | Goldstein | 40/10 R |
| 4,174,909 | 11/1979 | Jahn | 402/13 |
| 4,179,138 | 12/1979 | Bogdanovic | 40/124.2 X |
| 4,274,567 | 6/1981 | Sawyer | 40/10 R |
| 4,477,048 | 10/1984 | Conway . | |

FOREIGN PATENT DOCUMENTS 394334 6/1933 United Kingdom .

*Primary Examiner*—Robert W. Gibson, Jr.
*Assistant Examiner*—Blair M. Johnson
*Attorney, Agent, or Firm*—Roberts, Spiecens & Cohen

[57] ABSTRACT

A holder for a plurality of sheet items adapted for being selectively mounted in a multiplicity of modes such as in a channel at the edge of the shelf, on a flat backing board, on a rod, on a riser card having holes therein or on a hook. The holder comprises a flat sheet of flexible material including a pivotable flap which initially is in the plane of the sheet and is capable of being resiliently bent out of the plane of the sheet such that its lower edge can act in combination with the upper edge of the sheet of the material to engage flanges of a U-shaped channel at the edge of a shelf to hold the sheet of material in flexed condition in the channel. A bendable prong is formed in the sheet and is bendable to a position projecting from the sheet for supporting a plurality of sheet items in front of the plane of the sheet at a level below the channel for removal one by one. The sheet includes an adhesive strip for attaching the sheet to a flat backing board. The sheet further includes wings at its lateral edges which are bendable out of the plane of the sheet to enable the wings to be inserted into the holes in a riser card to hold the sheet against the front of the riser card with the wings engaging the back of the riser card in secured relation. The folded wings also are engageable on a rod of a basket or similar construction. The sheet is also provided with a mounting hole above the flap to enable the sheet to be mounted on a hook.

36 Claims, 19 Drawing Figures

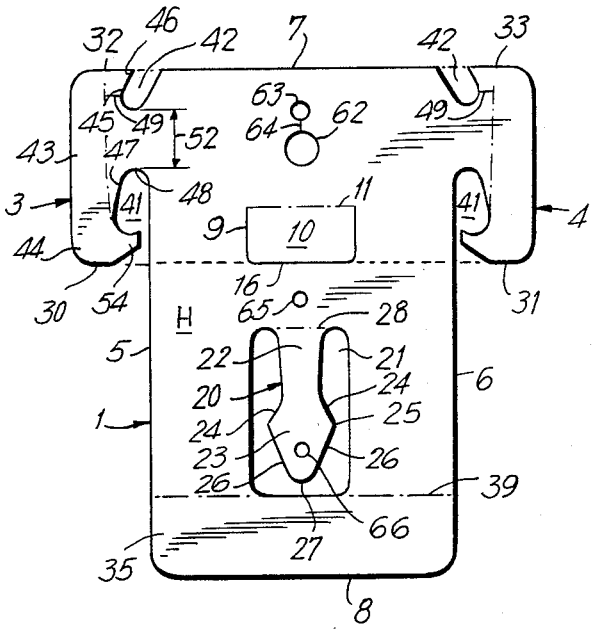
FIG. 1
FIG. 11
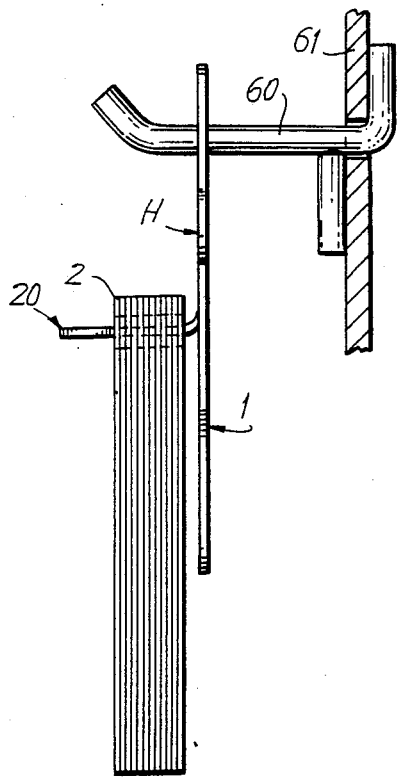
FIG. 10
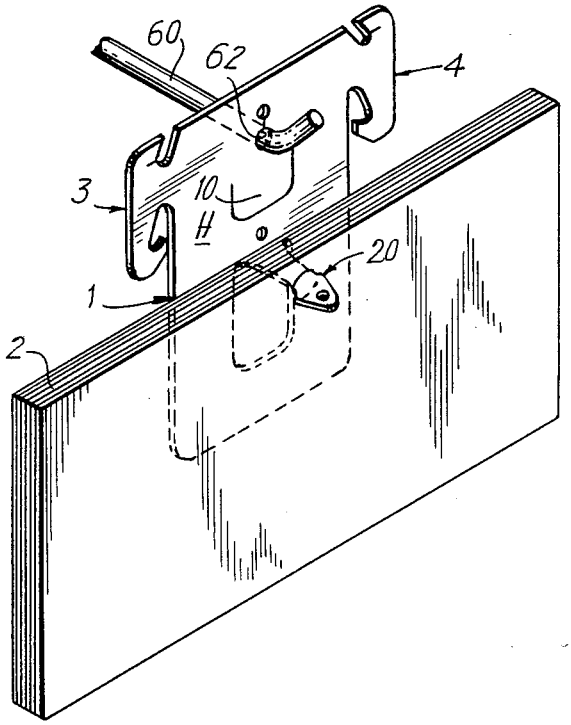

FIG. 2
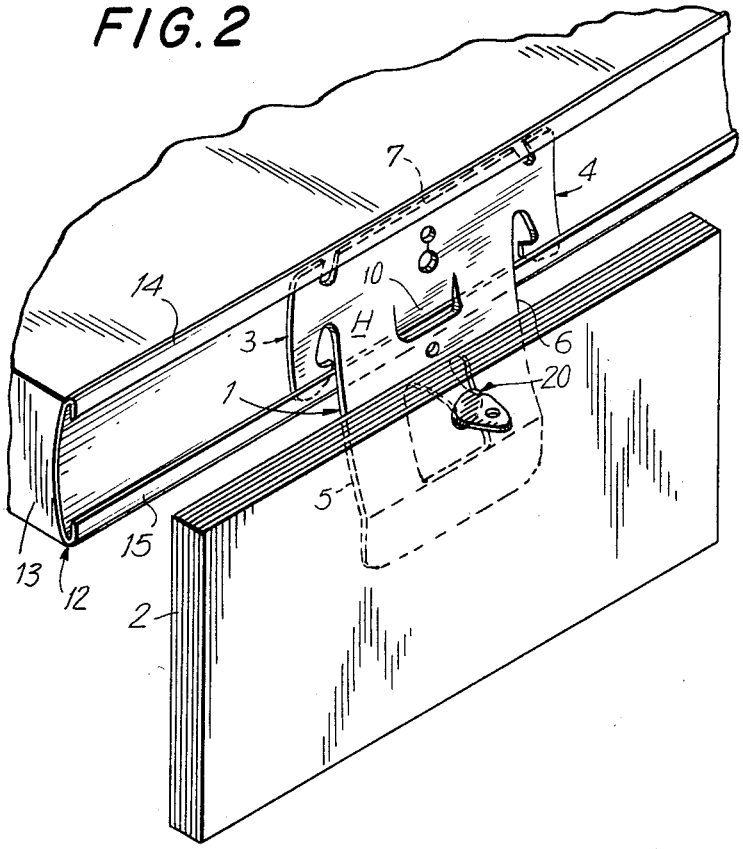
FIG. 3
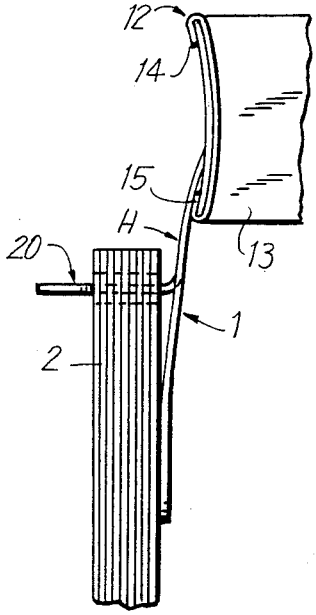
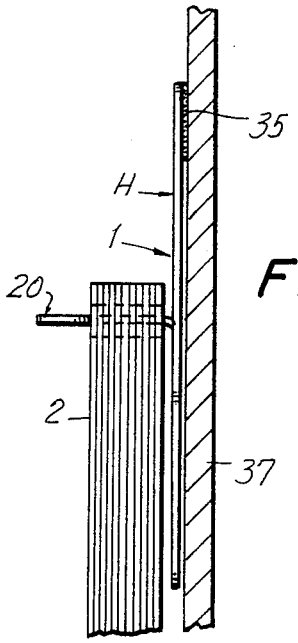
FIG. 5
FIG. 4
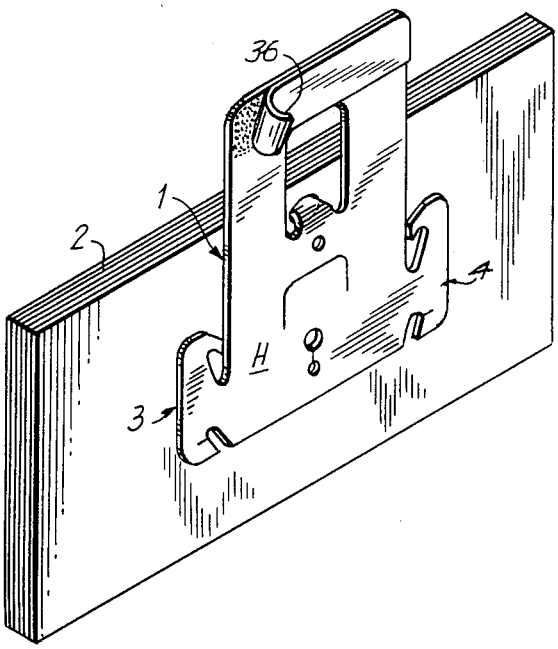
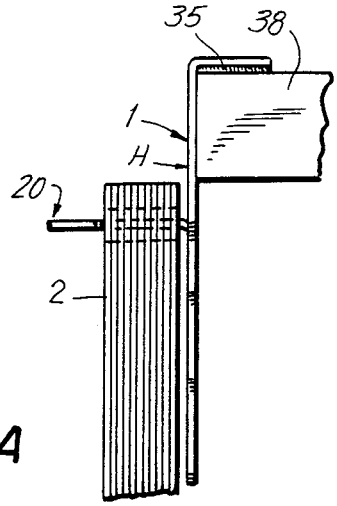
FIG. 5A

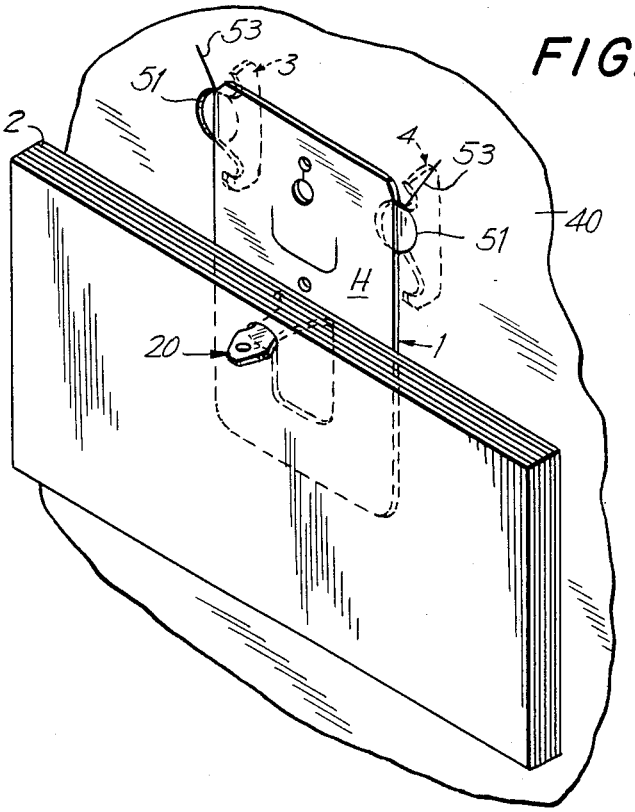
FIG. 6
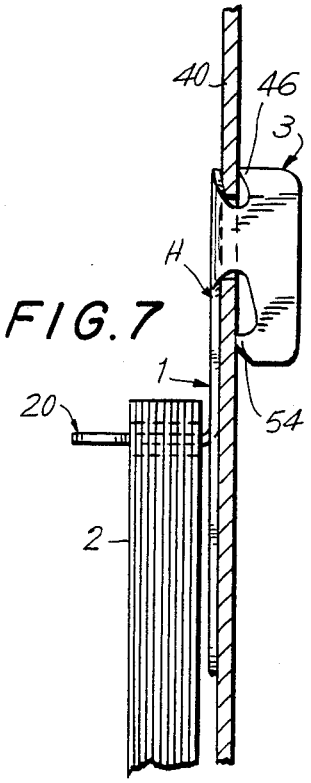
FIG. 7
FIG. 8
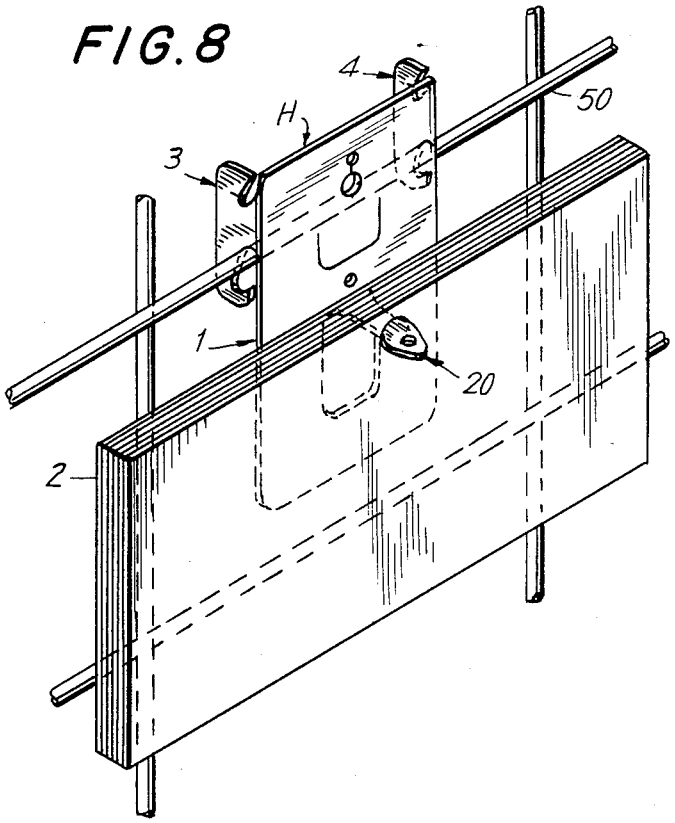
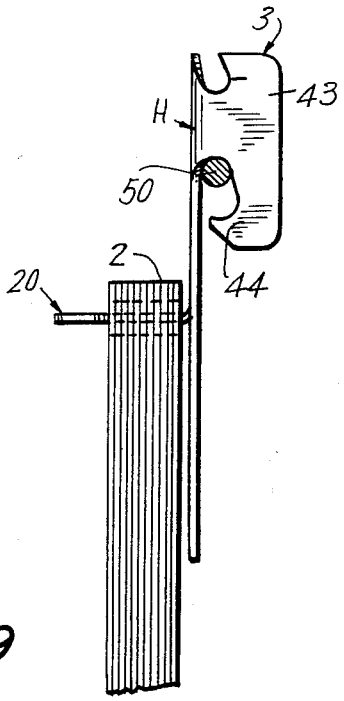
FIG. 9

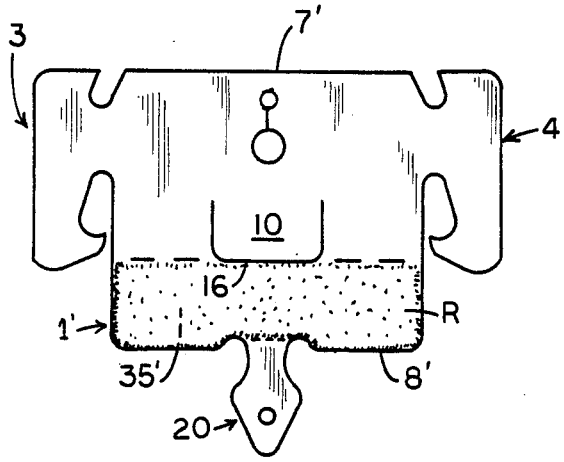
FIG. 12
FIG. 13
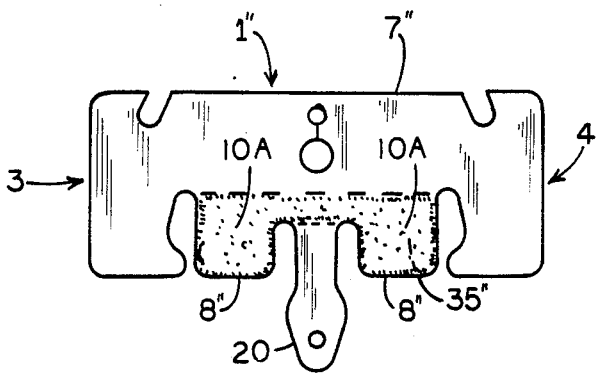
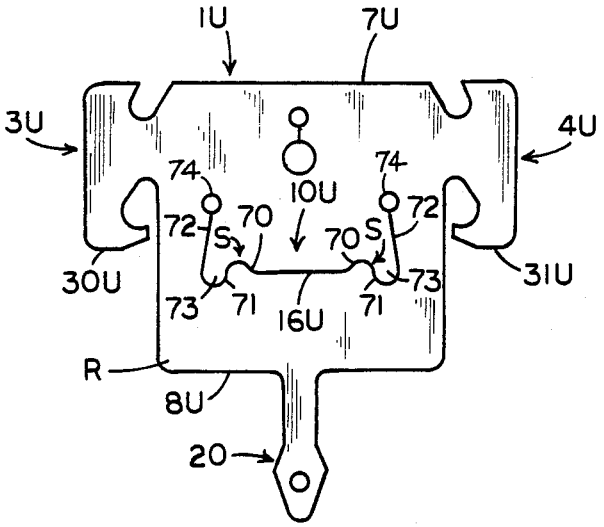
FIG. 14

PAD HOLDER ADAPTED FOR MULTIPLE MODES OF MOUNTING AND ASSOCIATED METHODS

CROSS-RELATED APPLICATION

This is a continuation-in-part application of Ser. No. 402,535 filed July 28, 1982.

FIELD OF THE INVENTION

The invention relates to a pad holder and particularly to a dispenser of sheet items adapted for being taken one by one in which the pad holder is adapted for multiple modes of mounting.

The invention also relates to associated methods of mounting the pad holder.

PRIOR ART

The invention is particularly concerned with a pad holder adapted for use in a supermarket or like environment for dispensing informational sheets or promotional sheets one by one from a pad. Various types of holders or dispensers are known in the art for this purpose and these have a wide variety of forms and shapes and manners of installation.

In an earlier patent of mine, U.S. Pat. No. 3,824,720, there is shown a device which is adapted for being mounted on a shelf in front of a price channel at the edge of the shelf and adapted for supporting a pad of tear-off sheets secured to a backer by means of staples.

While such a construction has substantial utility, it can only be employed in a single manner and it requires the use of staples for attachment of the sheets to the backer.

U.S. Pat No. 4,016,977 shows a pad of sheet material assembled on a support which is adapted for being engaged in a channel at the edge of a shelf. The sheets are secured to the support by means of a rivet which allows the sheets of material of the pad to be inverted for a second mode of installation utilizing an adhesive.

U.S. Pat. No. 1,452,851 discloses a dispenser of sheets of material which is also adapted for being supported in a channel at the edge of a shelf or against a flat surface. In this arrangement, the sheets of the pad are supported by means of a pin which extends into the support surface of the dispenser.

SUMMARY OF THE INVENTION

An object of the invention is to provide a holder which is of simple construction and which avoids the need for a pin, rivet or staples to support the sheets of material on the holder.

A further object of the invention is to provide a holder which is adapted for multiple modes of installation.

A further object of the invention is to provide a holder having a support structure for the sheets of material which will readily allow their removal one by one.

Yet another object of the invention is to provide a holder which is formed from a single sheet of material which integrally incorporates the means for holding the sheet items of the pad thereon.

Still another object of the invention is to provide a holder which can be shipped flat and which is formed from a single sheet of material which is provided with selective slots and holes enabling the holder to be brought to its assembled configuration.

In order to satisfy the above and further objects, the invention contemplates a holder of a plurality of sheet items adapted for being selectively mounted in a channel at the edge of a shelf, on a flat backing board, on a rod, on a riser card having holes therein, or on a hook.

In accordance with the invention, the holder comprises a flat sheet of flexible material having upper and lower edges and lateral side edges, said sheet including a pivotable flap which initially is in the plane of the sheet and is capable of being resiliently bent out of the plane of the sheet, such that its lower edge can be engaged in one flange of a U-shaped channel at the edge of a shelf while the upper edge of the sheet is engaged in the other flange of the U-shaped channel such that the sheet is held in flexed condition in the channel.

A bendable prong is formed in the sheet below the flap and extends beyond the lower edge of the sheet, the flap being bendable to a position projecting from the plane of the sheet for supporting a plurality of sheet items in front of the sheet at a level below the channel for removal of said sheet items one by one.

Said sheet of material further includes adhesive means thereon for attaching the sheet to the upper surface of a shelf with the prong remaining in the plane of the sheet and projecting beyond the edge of the shelf for supporting said sheet items in front of the shelf.

Said sheet of material further includes foldable wings at its lateral edges comprising depending arms having lower hook-shaped end portions. The wings are foldable out of the plane of the sheet to enable the arms to hold the sheet on a rod.

Said folded wings can also be inserted into holes in a riser card to hold the sheet of material against the front of the riser card with said wings engaging the back of said riser card by said hook-shaped end portion.

Said sheet of material is provided with a mounting hole above said flap to enable the sheet to be mounted on a hook engaged in the hole.

In all of the above mounting modes, the prong projects forwardly from the sheet of material and serves to hold the sheet items to be dispensed at the front.

In accordance with a feature of the invention, the prong includes a stem having one end bendably joined to the sheet of material and a head at the other end of the stem which tapers in width in a direction away from the stem. In this way, the sheet items can be reliably held on the stem by means of the head of the prong and the sheet items can be removed one by one by pulling them over the head of the prong.

According to a further feature of the invention, the head has a greater width than the stem at the juncture therewith and the head first increases in width from its juncture with the stem to a maximum width and then tapers towards a free end thereof. At said free end, the head is rounded. Furthermore, the head preferably has a hole therein to facilitate engagement with a tool to pull the prong through holes in the sheet items.

In further accordance with the invention, the wings are formed with engagement lips at their upper ends and when the wings are folded and engaged with the back of a riser card, such engagement is effected at the lower hook-shaped ends and at the upper engagement lips. In this way, the sheet of material is reliably held in secured position to the riser card.

In further accordance with the invention, the sheet of material is a flexible sheet of plastic in which the flap, prong and wings are formed by providing respective slots and shaped openings therein, as for example, by diecutting. In this way, the articles can be easily manufactured and are ready for assembly with the sheet items to be dispensed without the need for any additional fasteners, such as pins, rivets and staples.

A further object of the invention is to provide a method of selectively engaging a holder of a plurality of sheet items in the channel at the edge of a shelf, on a flat backing board or shelf, on a rod, on a riser card having holes therein, and on a hook.

The invention will be described hereafter in detail in relation to a specific embodiment thereof with reference to the attached drawing.

BRIEF DESCRIPTION OF THE SEVERAL VIEWS OF THE DRAWING

FIG. 1 is a front view of a holder according to the invention, in flat, unassembled condition.

FIG. 2 is a perspective view showing the mounting of the holder in a channel at the front edge of a shelf.

FIG. 3 is a side view of the assembly shown in FIG. 2.

FIG. 4 is a perspective view showing the holder in inverted position to which a plurality of sheet items have been assembled.

FIG. 5 is a side view showing the mounting of the assembly in FIG. 4 on a flat backing board.

FIG. 5*a* is a side view showing the assembly of FIG. 4 mounted on a shelf.

FIG. 6 is a perspective view showing the mounting of a holder on a riser card.

FIG. 7 is a side view of the assembly in FIG. 6.

FIG. 8 is a perspective view of a holder mounted on a rod.

FIG. 9 is a side view of the assembly shown in FIG. 8.

FIG. 10 is a perspective view showing the mounting of a holder on a hook.

FIG. 11 is a side view of the assembly in FIG. 10.

FIG. 12 is a front view of another embodiment of a holder according to the invention, similar to that in FIG. 1.

FIG. 13 is a front view of a further embodiment of a holder according to the invention similar to that in FIG. 12.

FIG. 14 is a front view of another embodiment of a holder according to the invention, similar to that in FIG. 12.

DETAILED DESCRIPTION

Figure 15:
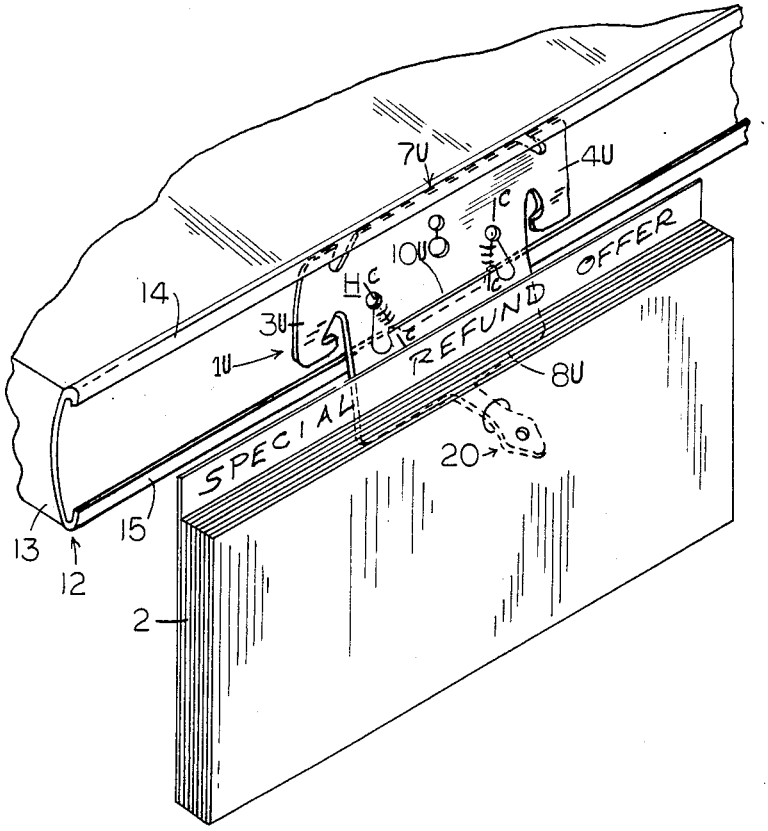
FIG. 15 is a perspective view showing the holder of FIG. 14 mounted in a channel at the front edge of a shelf.
Figure 16:
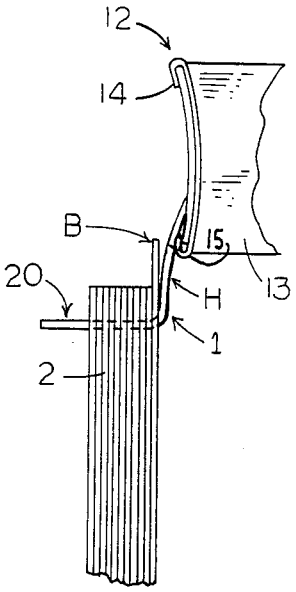
FIG. 16 is a side view of the assembly in FIG. 15.

Referring to FIG. 1 therein is seen a holder H for a plurality of sheet items adapted for being removed one by one. Referring briefly to FIG. 2 therein is seen the holder H in one mode of installation wherein a plurality of sheet items 2 are shown in position for being removed one by one. This will be explained in greater detail later.

Returning to FIG. 1, the holder H is constituted of a sheet 1 of relatively thin, flexible plastic material such as polyvinyl acetate, polyethylene, polystyrene or the like of a thickness of the order of 0.028 inches. The sheet of material is shipped flat and has the configuration as shown in FIG. 1 and is assembled in use with the sheet items 2 as will be explained later. As seen in FIG. 1, the sheet 1 is of rectangular form with lateral wings 3,4 at side edges 5,6 of the sheet. The sheet has an upper edge 7 and a lower edge 8. The sheet is provided with a U-shaped slot 9 which forms a tab or flap 10 which is capable of being pivotably bent out of the plane of the sheet at the remaining edge where it is integrally attached with the remainder of the sheet as shown at chain dotted line 11.

Referring again to FIG. 2 and also to FIG. 3, therein is seen the holder H mounted in a channel 12 at the edge of a shelf 13. The channel is of the type normally found in supermarkets and used for display of pricing information.

The channel 12 has upper and lower flanges 14,15 and the holder H is engaged in the channel 12 by engagement of upper edge 7 with flange 14 and engagement of lower edge 16 of flap 10 with flange 15. The distance between edges 7 and 16 is greater than the distance between flanges 14 and 15 so that holder H can be engaged in the channel by first engaging the edges in the flanges to produce an outwardly bent configuration for the holder whereafter inward pressure is applied to the holder to cause the holder to snap over center and assume a locked, concave configuration in the channel. In this way, the holder will be securely supported in flexed condition in the channel.

Referring again to FIG. 1, herein it is seen that the holder H is formed with an integral prong 20 whose shape is determined by stamping a generally U-shaped slot 21 from the material around the prong 20. The prong comprises a stem 22 which is integral with the remainder of the sheet at one end thereof and a head 23 which extends from the stem 22. The head increases in width from its juncture with the stem 22 along inclined sides 24 until it reaches a point of maximum width at 25. Thereafter, the head decreases in width along sides 26 until it reaches its free end which has a rounded form as shown at 27.

In order to mount the sheet items 2 on the holder H, the prong 20 is bent about a line 28 shown in chain dotted outline in FIG. 1 and inserted into holes in the sheet items 2. The sheet items 2 are then held on the prong by the head 23 of the prong. The rounded portion 27 and the taper of sides 26 of the head facilitates the insertion of the prong into the holes in the sheet items. The installation of the sheet items on the prong can be made prior to installation of the holder in channel 12. The head 23 of the prong is provided with hole 66 which can be engaged with a tool to pull the prong through the holes in the sheet items.

In the configuration shown in FIG. 2 the sheet items are now ready for removal one by one from the prong of the holder H. The taper of sides 24 facilitates the removal of each sheet individually. The width of the prong at 25 is greater than the diameter of holes in the sheet items mounted on the prong so that the sheet items will be retained by the head of the prong on the stem until the sheet items are dispensed in which case they are readily removable one by one from the prong.

If desired, the sheet items can be mounted on the prong prior to shipment in which case the holder H assembled with the sheet items 2 will be ready for use when received, merely by bending the prong from the plane of sheet 1. The sheet items 2 contain promotional or informational material of the type ordinarily available in supermarkets and other retail establishments.

As evident from FIG. 3, the sheet items, which may be mounted as a pad with a backing member, bear against the lower edge of the holder H when secured on the prong 20 to provide a secure and stable arrangement. The prong 20 is located below the flap 10 in a relative position with respect to the lower edge 8 of the sheet 1 to achieve this support and the sheet items 2 are held in a forwardly projected position in front of and below the channel to insure that the user will not come into contact with the edges of the flanges of the channel and cause injury.

It is to be noted that the lower edges 30,31 of wings 3,4 are respectively at the same level as edge 16 of flap 10 and that the upper edges 32,33 of wings 3,4 are at the same level as upper edge 7 of sheet 1. This enables the wings to be mounted in the channel with lower edges 30,31 in contact with flange 15 of channel 12 and upper edges 32,33 in engagement with flange 14 of channel 12 in precisely the same manner as lower edge 16 of flap 10 and upper edge 7 of sheet 1 are engaged in the channel.

In a lower edge portion of holder H, the sheet of material 1 is formed with a strip 35 of adhesive which is normally covered with a peel-off backing 36 as shown in FIG. 4. If the holder H is to be mounted on a flat backing board 37 as shown in FIG. 5, the peel-off backing 36 is removed from the back of adhesive strip 35 and the holder H is affixed to the board 37 as shown in FIG. 5 in which the holder H is in an inverted position as compared to the position shown in FIGS. 2,3 where the holder H has been mounted in the channel 12. The prong, however, is utilized in the same way insofar that it is bent from the plane of the sheet and is utilized to support the sheet items 2. As seen in FIG. 5 the sheet items are held in front of the plane of the sheet of material 1 secured to the backing board 37.

If the holder 11 is to be mounted on a flat shelf 38 as shown in FIG. 5A, then the holder H is bent around a line 39 as seen in FIG. 1 which represents the upper edge of the adhesive strip 35 and also the lower edge of U-shaped cutout 21. By bending the sheet of material 1 about bend line 39 and removing the peel-off backing 36, the holder H can be secured to the shelf 38 as shown in FIG. 5A.

The holder H also has the capability of being mounted on a riser card 40 as will be explained hereafter with reference to FIGS. 1,6,7. In order to mount the holder 11 on the riser card 40 the wings 3,4 are employed in the manner to be explained hereafter. The riser card 40 is generally utilized for promotional purposes and can be of standup or mounted type. Generally, it is made from cardboard or similar material and it can be readily provided with holes for receiving the wings 3,4.

The wings 3,4 are formed as appendages to the essentially rectangular configuration of the sheet bounded by edges 5,6,7,8. Preferably the wings 3,4 are formed by providing a T-shape for the sheet of material 1 as indicated by the chain dotted lines and slots or cutouts 41,42 are formed in sheet 1. The constructional features of the wing 3 will be described hereafter and it will be understood that the same construction applies to wing 4 which is the mirror image of wing 3.

Wing 3 includes a grip arm 43 which tapers in narrowing fashion towards a lower hook-shaped end portion 44. The tapered form of the grip arm is obtained by the tapered configuration of cutout 41. At its upper end, the grip arm has an inner edge 45 which is inclined upwardly due to the inclination of slot 42 and at its upper end the grip arm is formed with a pointed engagement lip 46. The tapered cutout 41 forms an inner edge 47 of the arm 43 and the edge 47 slopes upwardly to form a rounded edge 48 which joins to the side edge 5. The wings 3, 4 are employed to mount the holder H on the riser card as shown in FIGS. 6,7 or on a rod 50 as shown in FIG. 8,9. The sheet 1 is provided with a pair of slits 49 extending outwardly from edges 45. The slits 49 extend a length such that their outer ends are vertically aligned with the edges 47 at the widest part of cut outs 41 as shown by chain-dotted lines in FIG. 1. The slits 49 provide flexibility for the engagement lips 46 to enable the wings to accommodate riser cards of relatively thick material.

To achieve the mounting of the holder H on the riser card, the wings 3,4 are first bent rearwardly to a folded position substantially at right angles to the plane of the sheet. The riser card 40 is provided with spaced holes 51 at a distance from one another equal to the spacing of the folded wings 3,4. The diameter of the holes 51 substantially corresponds to the distance between the edge 48 of cutout 41 and the bottom of slot 42 which is designated by numeral 52 in FIG. 1. In order to insert the wings into the holes 51 in the riser card 40, slots 53 are provided in the riser card extending upwardly and outwardly from holes 51 at an angle of about 15 degrees with respect to the vertical. After the wings have been bent to their rearwardly folded positions, the hook-shaped lower end portions 44 are inserted into the holes and continued insertion of the wings takes place while the wing extends in part in the hole and in part in the slot 53 until the holder H is brought into a position flush against the face of the riser card. The wings, which are relatively resilient, are now positioned behind the riser card with the portions 52 extending through the holes 51. Because the wings are somewhat resilent, they may extend in a slightly inclined position due to their passage through the slots 53. The wings, therefore may require application of inward pressure to become aligned in a plane parallel to the lateral edges 5,6. When so aligned, the hook ends 54 of the hooked-shaped lower end portions 44 press against the back of the riser card as does the pointed engagement lips 46. This holds the holder H in tight secured position on the riser card. Because of the width of slot 42 and its inclined disposition and the tapered shape of cutout 41 and the rounded edge 48 thereof, a wide variation is provided for the location at which the wing can be bent from the plane of the sheet 1. This enables the wings to accommodate riser cards of different thicknesses of material. Also, due to the flexibility of the lower portion 44 of grip arm 43 and the flexibility of engagement lips 46 produced by slits 49, the wings are resilently engageable with riser cards of relatively great thickness.

As in the previous embodiments, the prong 20 is bent to project forwardly and support the sheet items thereon, in this case, in front of the riser card 40.

FIG. 8 shows the holder H mounted on rod 50 which may be a rod of a basket or rod assembly as commonly used in a supermarket. As seen in FIGS. 8,9 the wings 3,4 are bent out of the plane of sheet 1 to a rearwardly folded position and the lower hook-shaped end portions 44 are engaged over rod 50 so that the rod can enter the cutout 41 until the edge 48 is seated on the top of the rod. The flexibility of the wings permits them to be engaged over rods of various diameter without any difficulty whatsoever. As in the previous embodiments, the prong 20 is bent out of the plane of the sheet 1 to a forwardly projecting position to support a plurality of sheet items in front of the holder H as shown in FIGS. 8, 9.

FIGS. 10, 11 show the holder H mounted on a hook 60 of the type adapted for being engaged on a perforated board 61 as illustrated in FIG. 11. The sheet 1 is provided with a hole 62 located above the flap 10 at a position for receiving the end of hook 60 so that the holder H is suspended from the hook. In this embodiment, the wings 3,4 remain in the plane of the sheet 1 and are not bent therefrom. As in the other embodiments, however, the prong 20 is bent in a forwardly projecting fashion from the sheet 1 and is utilized to support the sheet items thereon as shown in FIGS. 10, 11. If the holder H is to be suspended on a nail, then the sheet of material is provided with a second hole 63 of a diameter corresponding to the shank of the nail and a slot 64 extends between holes 62, 63. The head or the nail is passed through the larger diameter hole 62 and the shank of the nail is passed through the slot 64 so that it will enter hole 63 and be tightly held therein.

As seen from the above, the invention provides a holder H formed form a flat sheet of material which can be shipped in flat condition and which requires no additional fasteners for its attachment with the sheet items to be held by the holder. The holder provides for a multiple number of modes of selective mounting of which a number have been described.

FIG. 12 shows another embodiment of a holder according to the invention similar to that in FIG. 1. Similar reference numerals will be used for the same elements and will not be described further. The distinctive features of the embodiment of the holder in FIG. 12 will be described in detail.

As in FIG. 1, the holder is composed of a sheet of thin flexible material designated by numeral 1'. The holder includes lateral wings 3,4 of substantially identical construction to those in the embodiment shown in FIG. 1. A tab or flap 10 is formed in the sheet in the same manner as in the embodiment in FIG. 1. The holder in FIG. 12 is foreshortened vertically as compared to the holder in FIG. 1 and has a lower edge 8' from which the prong 20 extends in depending relation below the edge. A strip of adhesive 35' is placed on the back surface of the sheet 1' in the region between the edge 16 of tab 10 and the lower edge 8' of the sheet.

In operation, when the holder is to be used to support a plurality of sheet items 2 from a channel 12, the prong 20 is bent upwardly from the plane of the sheet 1' so as to project in front thereof in much the same manner as shown in FIG. 2. However in contradistinction to the arrangement shown in FIG. 2, the sheet 1' terminates approximately at the level of the prong 20 and therefore will not project substantially behind the downwardly depending sheet items 2. As in the arrangement shown in FIG. 2, the installation of the holder within the channel 12 is effected by engaging the lower edge 16 of tab 10 against the lower flange 15 of the channel while the upper edge 7 of the sheet 1' will be engaged with the upper flange 14 of channel 12.

For use in mounting the holder against a wall, it is unnecessary to invert the holder and, instead, the peel-off layer on the adhesive strip 35' is removed and the holder adhered to the wall in the same upright position as that when installed in the channel 12. The provision of the adhesive strip 35' in entirety above the projecting prong 20 affords ample stability to the sheet items 2 supported on the prong 20.

In order to mount the holder on a shelf in the manner as illustrated in FIG. 5A, the entire holder is placed on the top surface of the shelf with the adhesive strip 35' positioned at the edge of the shelf and the prong 20 extending beyond the shelf in the plane of the sheet 1'. The adhesive strip 35' thereby serves to support the sheet 1' on the top surface of the shelf with the prong and the sheet items 2 supported thereon in front of the shelf at the same level thereas. With this arrangement it is unnecessary to bend the sheet to attach it to the top of the shelf as shown in the embodiment of FIG. 5A.

As is evident from the above, the embodiment shown in FIG. 12 requires less material and avoids the need to invert the holder when mounting the same on a flat vertical wall while also avoiding the need to bend the sheet when installing the holder on a horizontal shelf.

FIG. 13 shows a further embodiment which is similar to that of the embodiment of FIG. 12. In FIG. 13 is seen a sheet 1'' of plastic material with lateral wings 3 and 4. The wings 3 and 4 are substantially the same as those shown in FIG. 12 which, in turn, are identical to those shown in the embodiment of FIG. 1. In FIG. 13 the prong 20 is secured to the sheet 1'' at a location above the lower edge 8'' of the sheet 1''. As a consequence, two separate ears 10A are formed on opposite lateral sides of the prong 20. An adhesive with a peel-off strip is placed on the rear surface of sheet 1'' to cover the dotted area shown in FIG. 13. The adhesive strip is designated by 35''.

In order to install the holder in FIG. 13 into channel 12 the lower edges 8'' are engaged in the bottom of channel 12 and the upper edge 7'' is engaged in the upper flange of channel 12. The holder is then secured in the channel in substantially the same manner as the holders of FIGS. 1 and 12. The prong 20 is bent forwardly out of the plane of the sheet 1'' so as to carry the sheet items 2 in front of the channel in a manner similar to that illustrated in FIGS. 2 and 3.

In order to install the holder of FIG. 13 against a vertical panel, the peel-off backing on the adhesive strip 35'' is removed and the holder is placed against the panel in the same orientation as when it was inserted into the channel 12. In other words, as in the embodiment of FIG. 12, it is unnecessary to invert the holder in order to assemble it to a vertical wall as is the case for the embodiment of FIG. 1.

Also similar to the embodiment of FIG. 12, the installation of the holder on a horizontal shelf is effected by removing the peel-off strip from the adhesive 35'' and placing the holder on the shelf with the prong 20 projecting in front of the shelf.

A feature of the embodiment shown in FIG. 12 is that a clear region R is formed on the front surface of the holder between the lower edge 16 of tab 10 and edge 8'. In the embodiment of FIG. 1 a similar region is formed between edge 16 of tab 10 and bend line 28. This region is exposed above the upper edge of sheet items 2 installed on prong 20 and when the assembly is fitted in the channel 11 as shown in FIG. 2, the region will be disposed in front of and below the channel 12 so as to be visible to the user. This region can be provided with information suitable for the user, such as by direct imprinting or by placing adhesive stickers on the holder in the region.

FIG. 14 shows a further embodiment which is similar to that of FIG. 12. Similar reference numerals will be used for corresponding elements with the suffix U. In FIG. 14 the holder comprises a sheet 1U which has a prong 20 at the lower edge 8U of the sheet as in the embodiment of FIG. 12. The embodiment of FIG. 14 is essentially distinguished from that of FIG. 12 in the manner in which the holder is engaged in the channel.

In this regard, the wings 3U and 4U are foreshortened in their height dimension such that the lower edges 30U and 31U are located at a level above the lower edge 16U of tab 10U. In this way the wings 3U and 4U do not participate in the engagement of the holder in the channel 12. In this regard, the holder is secured in the channel solely under the action of the upper edge 7U of the sheet and the tab 10U.

In particular, it is seen that the tab 10U is formed with inclined re-entrant cuts 70 which extend into double curvature portions 71 leading to side edges 72 of the tab. As a consequence, at the lower lateral sides of the tab, there are formed ears 73 which are connected to the lower edge 16U by undercut shoulders S formed by cuts 70 and 71.

In order to install the holder in channel 12, the upper edge 7U of the holder is engaged with the upper flange of the channel and the tab 10U is bent rearwardly from the plane of sheet 1U so that lower edge 16U of the tab can engage behind the lower flange of the channel. The ears 73 are disposed in front of the lower flange such that the shoulders S ride over the edges of the lower flange when the lower edge 16U is engaged within the channel. This provides a powerful locking action which securely holds the holder in place in order to withstand the forces applied to the holder by removal of the sheets from the prong 20.

Of significance is the fact that when the tab 10U is bent rearwardly from the plane of the sheet, it exerts a twisting action on the ears 73 tending to turn the ears inwardly towards the central axis of the holder. This produces a concave bend in the plastic sheet material at each end centered along an axis C—C extending from the upper edge of cut 70 toward the hole 74 located at the top of edge 72. This concave bend provides an intensified engagement of the tab with the lower flange of the channel at the shoulders S. By reason of this construction, it is not necessary for the lower edge 16U to extend to the bottom of the lower flange in the channel. This is the case because secure assembly of the holder in the channel is not obtained by engagement of the upper and lower edges at the bottom of the upper and lower flanges as in the previous embodiments but rather, by the engagement of upper edge 7U in the bottom of the upper flange of the channel and the engagement of the shoulder S with the edge of the lower flange. As a consequence, precise manufacture with close tolerances of the distance between the upper edge of the sheet and the lower edge of the tab as in the previous embodiments is no longer necessary as it is only required for the lower edge 16U of the tab 10U to extend beyond and behind the edge of the lower flange of the channel in order to lock the shoulders S on the lower flange of the channel 12. Hence, the embodiment in FIG. 14 does not rely on snapping the holder to a concave configuration to lock the holder in the bottom of the flanges of the channel as in the embodiment of FIG. 1. Rather, the upper edge 7U of the holder is engaged in the bottom of the upper flange and the tab 10U is snapped behind the free edge of the lower flange which produces the concave bends in the holder and locks the holder in the channel in flexed or stressed condition.

As in the embodiment of FIG. 12, a clear region R is formed between the lower edge 8U of the holder and the lower edge 16U of the tab 10U. In point of fact, the ears 73 partially intrude into this region, but this is of no significance and printing or attachment of stickers in the region can be provided below the ears 73.

As in the embodiment in FIG. 12, an adhesive strip (not shown) is provided on the rear surface of the sheet 1U over an area equal to or less than the aforesaid region R.

The sheet items 2 can be mounted on a backing sheet or board B and in accordance with the invention, the backing sheet B extends obove the sheet items 2 so that the area proximate the upper edge of the backing sheet B is visible above the sheet items 2 in a region below the channel 12 so as not to obscure the price markings or other information contained within the channel. As can be seen, various indica can be placed on the backing sheet so as to give further information to the user.

Figure 17:
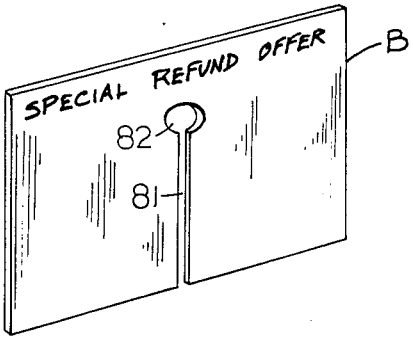
FIG. 17 is a perspective view of a backing sheet adapted for insertion on the prong of a holder.

It may be suitable to affix the backing sheet B which extends above sheet items 2 after a pad with a flush backing sheet has been assembled on the prong. For this purpose, the backing sheet B can be formed, as illustrated in FIG. 17, with a longitudinal slot 81 extending from its lower edge into an enlarged hole 82. The dimensions of the slot 81 and the hole 82 are such that the backing sheet B can be installed on the bent prong 20 after the pad of sheet items 2 has been mounted on the prong. In this way, it is also possible to add additional backing sheets with modified indica to the assembly to change the display from time to time as the occasion dictates. Furthermore, the area of projection of the backing sheet B can be to either side or the bottom of the pad instead of or in addition to the upper region as shown.

Figure 18:
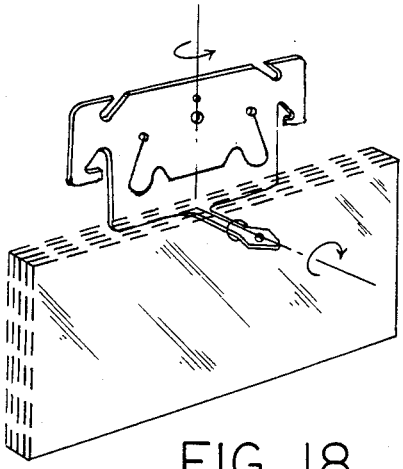
FIG. 18 diagrammatically shows front to back reversal of the position of the holder of FIG. 14 with the sheet items thereon.

Sometimes it is necessary to stabilize the backing sheet, particularly if the backing sheet is made of relatively thin material. This can be achieved by utilizing the adhesive strip on the rear face of the holder. To bring the rear face to the front after sheet items have been mounted on the prong, the sheet items are held in one hand and the holder is twisted about its vertical central axis as shown in FIG. 18. The flexibility of the prong 20 and its pivotal connection to the holder allows the prong to turn over about its longitudinal axis as shown. The adhesive strip on the rear face of the holder will now be positioned frontwards so that upon removal of the cover strip, the backing sheet can be adhered to the holder so as to be securely held in position. If a different backing sheet with different indicia thereon is to supercede the first backing sheet already in position it is only necessary to insert the new backing sheet in front of the first which will serve as a support therefor.

It will become apparent to those skilled in the art that other modes of mounting may become possible and numerous modifications and variations of the specific features of the disclosed invention may present themselves to those skilled in the art to achieve this as well as other equivalents of the invention as seen in the attached claims.

Thus, for example while the wings 3,4 have been shown as engageable in the channel 12 in the embodiments of FIGS. 1,12, and 13 this is not essential for installation of the holder H in the channel as this is achieved by the lower edge of tab 10 and the upper edge 7 of sheet 1. The wings 3,4 can thus extend in front of channel 12 when the holder is secured in the channel. In some cases it may be desirable to bend the wings 3,4 frontwardly to suspend material, such as promotional sheets or the like thereon, either in addition to or replacement of sheet items 2.

What is claimed is:

1. A dispenser of sheet items, adapted for being mounted in a U-shaped channel at the edge of a shelf by engaging the flanges of the channel, said dispenser comprising a substantially, flat sheet of flexible material having upper and lower edges, said sheet of material being mountable in a U-shaped channel having upper and lower flanges mounted at the edge of a shelf, the spacing of the upper and lower edges of the sheet being such to enable said edges to engage the flanges of the U-shaped channel to hold said sheet in flexed condition in said channel, and a bendable prong extending downwardly from said sheet beyond said lower edge for movement between a first position in the plane of the sheet and a second position projecting from the plane of said sheet, said prong including a stem and a head, said stem having one end integrally and bendably formed to said sheet and an opposite end to which said head is integrally connected, said head having a greater width than said stem and forming laterally extending sides at the juncture therewith, said head tapering in width from said laterally extending sides in a direction away from said stem to a free end of said head such that said prong can support a plurality of sheet items on said stem while said lateral sides retain said sheet items on the prong in front of the plane of said sheet and said sheet items can be removed one by one from the prong.

2. A dispenser as claimed in claim 1 comprising adhesive means on said sheet.

3. A dispenser as claimed in claim 2 wherein said adhesive means extends to said lower edge of said sheet.

4. A dispenser as claimed in claim 3 wherein said adhesive means extends across the width of said sheet.

5. A dispenser as claimed in claim 1 wherein said prong extends from said lower edge of said sheet downwardly.

6. A dispenser as claimed in claim 5 comprising adhesive means on said sheet on the rear surface thereof.

7. A dispenser as claimed in claim 1 wherein said sheet further comprises a pair of ears each having a lower edge forming part of said lower edge of the sheet means which engages the respective flange of the U-shaped channel.

8. A dispenser as claimed in claim 7 comprising adhesive means on said ears.

9. A dispenser as claimed in claim 1 wherein said head first increases in width along said sides from the juncture thereof with said stem to a maximum width and then tapers towards laterally extending said free end.

10. A dispenser as claimed in claim 9 wherein said head is rounded at said free end.

11. A dispenser as claimed in claim 9 wherein said head has a hole therein.

12. A dispenser as claimed in claim 1 wherein said sheet of material has lateral edges and foldable wings at said lateral edges.

13. A dispenser as claimed in claim 12 wherein said wings each comprises a depending grip arm including a hook-shaped lower end portion.

14. A dispenser as claimed in claim 13 wherein said grip arm tapers in narrowing fashion towards said hook-shaped lower end portion.

15. A dispenser as claimed in claim 14 wherein each said grip arm is formed by the provision of a tapered slot in said sheet of material.

16. A dispenser as claimed in claim 15 wherein said sheet of material is formed with a second slot at each wing extending from said lateral edge of said sheet of material.

17. A dispenser as claimed in claim 16 wherein said second slot is inclined with respect to said lateral edge to form an engagement lip on the respective wing at an upper end thereof remote from said hook-shaped lower end portion.

18. A dispenser as claimed in claim 17 wherein said slots are spaced from one another to define a region of material therebetween constituting a bend line for the respective wing to enable the wing selectively to remain in the plane of the sheet of material or to be bent therefrom.

19. A holder of a plurality of sheet items adapted for being selectively mounted in flanges of a U-shaped channel at the edge of a shelf, on a flat backing board, or on the edge of a shelf, said holder comprising a flat sheet of flexible material having upper and lower edges and lateral side edges, said upper and lower edges being spaced apart to engage flanges of a U-shaped channel at the edge of a shelf to hold the sheet in flexed condition in said channel, a bendable prong integrally formed in said sheet and extending below said lower edge for supporting a plurality of sheet items in front of the plane of the sheet at a level below said channel for removal one by one, said prong including a stem and a head, said stem having one end integrally and bendably formed to said sheet and an opposite end to which said head is integrally connected, said head having a greater width than said stem and forming laterally extending sides at the juncture therewith, said head tapering in width from said laterally extending sides in a direction away from said stem to a free end of said head such that said sheet items can be supported on said stem and retained thereon by said lateral sides, said sheet including a strip of adhesive means thereon for attaching said sheet to a flat backing board with the prong bent forwardly from the plane of the sheet or for attaching the sheet to the upper surface of a shelf with the prong projecting forwardly beyond the edge of the shelf.

20. A holder as claimed in claim 19 wherein said sheet further includes foldable wings at said lateral edges comprising depending arms having lower hook-shaped end portions, said wings being foldable out of the plane of the sheet to enable said arms to hold the sheet on a rod, said wings when folded being insertable into holes in a riser card to hold said sheet against the front of said riser card with said wings engaging the back of said riser card to said hook-shaped end portions, said sheet being provided with a mounting hole to enable the sheet to be mounted on a hook engaged in said hole.

21. A dispenser of sheet items, adapted for being mounted in a U-shaped channel at the edge of a shelf by engagement with flanges of the channel, said dispenser comprising a substantially, flat sheet of flexible material having upper and lower edges and including flap means including a portion which can be bent out from the plane of the sheet, said portion of the flap means having an edge which is spaced from said upper edge of the sheet and disposed out of the plane of the sheet when said portion of the flap means is bent out from the plane of the sheet, the spacing of the upper edge of the sheet and said edge of the flap means being such to enable said edges to engage the flanges of a U-shaped channel at the edge of a shelf, said flap means further including means for engaging one of the flanges of the channel at the front thereof to act in combination with said flap means which is bent out of the plane of the sheet to hold the dispenser securely on said flange, and a bendable prong extending downwardly from said sheet beyond said lower edge for movement between a first position in the plane of the sheet and a second position projecting from the plane of said sheet, said prong being shaped to support a plurality of sheet items thereon in front of the plane of said sheet and to enable said sheet items to be removed one by one from the prong.

22. A dispenser as claimed in claim 21 wherein said means for engaging said one flange of the channel at the front thereof comprises an ear formed on said flap means, and a shoulder joining said ear with said portion of the flap means which is bent from said one plane of the sheet to engage the flange of the channel, said one shoulder extending over said flange of the channel.

23. A dispenser as claimed in claim 22 wherein said shoulder is formed by an undercut in said sheet between said ear and said portion of the flap means.

24. A dispenser as claimed in claim 21 comprising adhesive means on said sheet in a region between said prong and said edge of said flap means.

25. A dispenser as claimed in claim 21 wherein said sheet of material has lateral edges and foldable wings at said lateral edges.

26. A dispenser as claimed in claim 26 wherein said wings have lower edges located at a level above the level of said edge of said flap means.

27. A dispenser as claimed in claim 21 wherein the rearmost of the sheet items extends above the remainder of the sheet items in front of said sheet of material in a region between said prong and said edge of said flap means so as to be visible to a user without obscuring the U-shaped channel.

28. A dispenser as claimed in claim 27 wherein said rearmost sheet item has a slot enabling the sheet item to be slipped on the prong after the other sheet items have already been installed on the prong.

29. A dispenser as claimed in claim 21 in combination with said sheet items, the latter having holes therein for insertion of said prong therein, at least one of said sheet items having a slot extending from said hole therein to facilitate mounting said sheet item on said prong.

30. A method of mounting a plurality of sheet items on a holder in the upper and lower flanges of a U-shaped channel at the edge of a shelf, said method comprising bending a prong from the plane of a sheet of material of the holder and pulling the prong through holes in a plurality of sheet items such that the sheet items are loosely held on the prong and are capable of being pulled from said prong one by one, the holder having upper and lower edges and a pivotal flap with a respective lower edge and an ear connected to the edge by a shoulder, and installing said holder in a U-shaped channel having upper and lower flanges with the sheet items suspended in front of and below the channel by engaging the upper edge of the holder in the channel in engagement with the upper flange and engaging the lower edge of the pivotal flap of the holder in the channel in engagement with the lower flange at the back thereof while the ear of the holder fits against said lower flange at the front thereof and the shoulder rides on the lower flange.

31. A method as claimed in claim 30 comprising forming one of the rear sheet items with a greater height than the remainder of the sheet items such that said one sheet item extends above the remainder of sheet items in front of the holder above said prong but below the channel.

32. A method as claimed in claim 31 wherein said one sheet item is installed on the prong after the other sheet items.

33. A method as claimed in claim 32 comprising adhesively securing said one sheet item to said holder.

34. A dispenser of sheet items comprising a substantially, flat sheet of flexible material having upper and lower edges and including flap means including a portion which can be bent out from the plane of the sheet, said portion of the flap means having an edge which is spaced from said upper edge of the sheet and disposed out of the plane of the sheet when said porton of the flap means is bent out from the plane of the sheet, and a bendable prong projecting from said lower edge in the plane of the sheet for supporting a plurality of sheet items thereon in front of the plane of said sheet, said flap means including an undercut shoulder joined to said edge of said portion of said flap means, and an ear connected to said shoulder, said ear being bendable with respect to said edge of said portion of said flap means.

35. A dispenser as claimed in claim 34 wherein said sheet of material has lateral edges and foldable wings at said lateral edges.

36. A dispenser as claimed in claim 35 wherein said wings have lower edges located at a level above the level of said edge of said portion of said flap means.

* * * * *